US005665016A

United States Patent [19]

Burnett

[11] Patent Number: 5,665,016

[45] Date of Patent: Sep. 9, 1997

[54] BASKETBALL TRAINING DEVICE

[75] Inventor: Hollis Burnett, San Jose, Calif.

[73] Assignee: Leonard Nash, Navato, Calif.

[21] Appl. No.: 560,885

[22] Filed: Nov. 20, 1995

[51] Int. Cl.[6] ..... A63B 69/00

[52] U.S. Cl. ..... 473/448

[58] Field of Search ..... 273/1.5 R, 1.5 A, 273/26 R, 187 R; 473/270, 448; 434/248

[56] References Cited

U.S. PATENT DOCUMENTS

| | | | |
|---|---|---|---|
| 1,484,390 | 2/1924 | Gibbs et al. | 473/270 X |
| 2,039,794 | 5/1936 | Hayden | 273/1.5 A |
| 3,342,487 | 9/1967 | David | 273/26 R |
| 3,825,257 | 7/1974 | Palmer | 273/1.5 A |
| 3,979,116 | 9/1976 | Matchick | 273/26 R |
| 4,206,915 | 6/1980 | Woodcock | 273/1.5 A |
| 4,213,606 | 7/1980 | Wilson | 273/1.5 A |
| 4,226,416 | 10/1980 | Callahan | 273/1.5 A |
| 4,244,569 | 1/1981 | Wong | 273/1.5 A |
| 4,506,886 | 3/1985 | Lamb | 273/1.5 A |
| 4,836,539 | 6/1989 | Knapp | 273/1.5 A |
| 4,903,964 | 2/1990 | Anderson | 273/1.5 R |
| 4,904,981 | 2/1990 | Mele et al. | 273/1.5 R X |
| 4,905,995 | 3/1990 | Apo | 273/1.5 R |
| 4,915,381 | 4/1990 | Hackett | 273/1.5 A |
| 5,125,651 | 6/1992 | Keeling | 273/1.5 A |
| 5,133,546 | 7/1992 | Matherne et al. | 273/1.5 A |
| 5,156,394 | 10/1992 | Deal | 273/1.5 R |
| 5,207,789 | 5/1993 | Gates | 273/1.5 A |
| 5,224,699 | 7/1993 | Zaruba | 273/1.5 R |
| 5,294,913 | 3/1994 | Mower et al. | 273/1.5 R X |
| 5,308,059 | 5/1994 | Owen | 273/1.5 R |
| 5,354,048 | 10/1994 | Winesberry | 273/1.5 A |
| 5,364,092 | 11/1994 | Riepe | 273/1.5 A |
| 5,365,427 | 11/1994 | Soignet | 364/410 |
| 5,390,912 | 2/1995 | Silagy | 273/1.5 A |
| 5,405,132 | 4/1995 | St. Onge | 273/1.5 R |

OTHER PUBLICATIONS

KBA Basketball Coaching and Training Aids 1989 School Mail Order Catalog, p. 13, Spot Shots Dec. 1988.

*Primary Examiner*—Paul E. Shapiro

*Attorney, Agent, or Firm*—Ropers, Majeski, Kohn & Bentley

[57] ABSTRACT

Device for improving the accuracy of shooting a basketball, comprising an annular member shaped to define the desirable path of the shot basketball, a ball striking flap disposed within the annular member, and electronic indicators in communication with the ball striking flap to indicate that a ball, although passing through the device, was shot with a less than ideal trajectory path. In a second embodiment, the device also comprises a user guideline, foot placement pads, means for increasing the visibility of the top annular surface and securing straps for securing the annular member to the standard rim of the basketball goal.

4 Claims, 2 Drawing Sheets

BASKETBALL TRAINING DEVICE

I. FIELD OF THE INVENTION

This invention relates to a basketball training device. In particular, it comprises the combination of several features for use with a standard basketball goal to improve the aim of a basketball player by helping the player determine and repeat the ideal trajectory of a shot ball, especially from a free throw line, but also from other shooting positions.

II. BACKGROUND OF THE INVENTION

There are numerous inventions designed to improve the aim of a free throw shooter in the game of basketball. As with this invention, many are to be used with a standard basketball goal for improving a player's aim. None of the inventions known to this applicant comprises the same features for achieving this end.

U.S. Pat. No. 5,156,394, issued to Richard Deal, comprises an annular member positioned below the standard basketball rim. An ideally shot ball will pass through this annular member. U.S. Pat. No. 5,125,651, issued to Edward Keeling, comprises a plurality of hoops positioned such that a line representing the descending path of a desirably shot basketball will pass substantially through the centers of both of the basketball hoops.

U.S. Pat. No. 5,207,789, issued to Horace Gates, comprises a rim which is smaller in diameter than the standard rim and which is placed over the standard rim in order to make the diameter smaller. The idea behind this invention is that if the player becomes accustomed to a smaller diameter, aim will be improved. U.S. Pat. No. 5,308,059, issued to Aubrey Owen, Jr., similarly comprises interchangeable hoops of decreasing diameter for use with the standard size hoop. U.S. Pat. No. 5,364,092, issued to Addison Riepe, comprises a smaller diameter rim which is placed within the standard rim and secured with a plurality of horizontally extended brackets.

U.S. Pat. No. 4,506,886, issued to Don Lamb, and U.S. Pat. No. 4,244,569, issued to James Wong, comprise a target positioned above the goal's rim in a vertical center line of the plane of the rim. This target is displaced when hit by a thrown ball. The goal of this invention is to encourage the shooter to aim at a spot just above the center line of the rim. U.S. Pat. No. 5,390,912, issued to Howard Silagy, comprises a bright ball suspended within the rim and net, approximately 3 to 4 inches below the plane of the rim.

U.S. Pat. No. 4,206,915, issued to Carl Woodcock, comprises radially extending members (extending from the rim), which support free standing vertical elements, again to improve the player's aim by deflecting basketball shots having an undesirable trajectory.

U.S. Pat. No. 4,213,606, issued to Robert Wilson, comprises a secondary hoop which projects upwardly and outwardly from the conventional hoop at the point opposite the backboard.

U.S. Pat. No. 5,354,048, issued to Cornelius Winesberry, comprises members extending upright from the hoop to provide a target area between the uprights at which the shooter aims.

U.S. Pat. No. 4,915,381, issued to Mark Hackett, comprises a ball rotatably held on a chord at approximately the center of the plane of the rim to provide a target for the shooter.

U.S. Pat. No. 5,365,427, issued to Gerard Soignet, uses a combination of a computer, laser and other devices to indicate the optimal shot path of a basketball.

U.S. Pat. No. 3,825,257, issued to George Palmer, comprises a shelf and backboard and a light and buzzer which are activated when the shelf is hit by a ball.

U.S. Pat. No. 4,226,416, issued to Robert Callahan, comprises an arcuate rigid member attached to the rim and defining a semi-elliptical space through which the desirably shot ball will pass through.

U.S. Pat. No. 4,836,539, issued to Daniel Knapp, comprises a conical, open ended, outwardly flaring target supported on the rim of the goal and defining a target designed to improve a basketball shooter's accuracy.

None of the above patents disclose the invention which is the subject of this application.

Improving a player's shot and committing it to "memory" is vital to better scoring ability. An ideally shot ball is one which has a trajectory which places the ball in the center point of the annular rim so that it passes unimpeded through the goal. Unfortunately, this center point is not visible to the player. Further, a ball shot with a less ideal trajectory will ultimately go through the goal, but less consistently, because it will strike the rim or backboard before passing through the goal.

This invention helps a player "see" the target, define the ideal trajectory path and repeat it in practice. The invention helps define the path both affirmatively and negatively. The invention which is the subject of this application comprises an annular member of such a shape that a ball shot with the optimal arch will pass through the member. The top annular surface of the invention is disposed at an angle such that it is visible to the player and such that only a desirably shot ball will pass through. This top annular surface can be brightly colored or otherwise adorned for increased visibility. Ideally, this angle (between the top surface of the device to the bottom surface of the device) is between 20 and 30 degrees.

In a second embodiment, a ball shot with a less than optimal arch, but well enough to pass through the member will activate a light or buzzer or both to provide feedback to the user. In this embodiment, a ball striking flap is disposed within the annular member. An indicator switch is activated by the ball striking flap and electrical indicators are in turn activated by the indicator switch. The indicator switch can activate a light and/or buzzer. A ball which is shot too "deeply", for example, will strike the ball striking flap and activate the light or buzzer.

In another embodiment, a user guideline extends from the front of the cylindrical member to a foot placement pad. Proper foot placement is indicated by a plurality of foot prints, the proper selection of which depends upon the height of the player.

In the preferred embodiment, this invention includes features and uses materials which enhance the security of the device to the basketball goal and enhances the device's usefulness and effectiveness.

III. SUMMARY OF THE INVENTION

The invention which is the subject of this application comprises an annular member which defines a ball arch guide, a ball striking flap disposed within the annular member, an indicator switch activated by the ball striking flap and electrical indicators activated by the indicator switch. In another embodiment, a user guideline extends from the front of the cylindrical member to a foot placement pad. The top annular surface can be painted brightly, for example, to have enhanced visibility. Of the preferred embodiments, the indicator switch can activate a light or buzzer. A ball which is shot with an undesirable trajectory will strike the ball striking flap and activate the light or buzzer.

IV. BRIEF DESCRIPTION OF THE DRAWINGS

V. DETAILED DESCRIPTION OF THE PREFERRED EMBODIMENT

Figure 1:
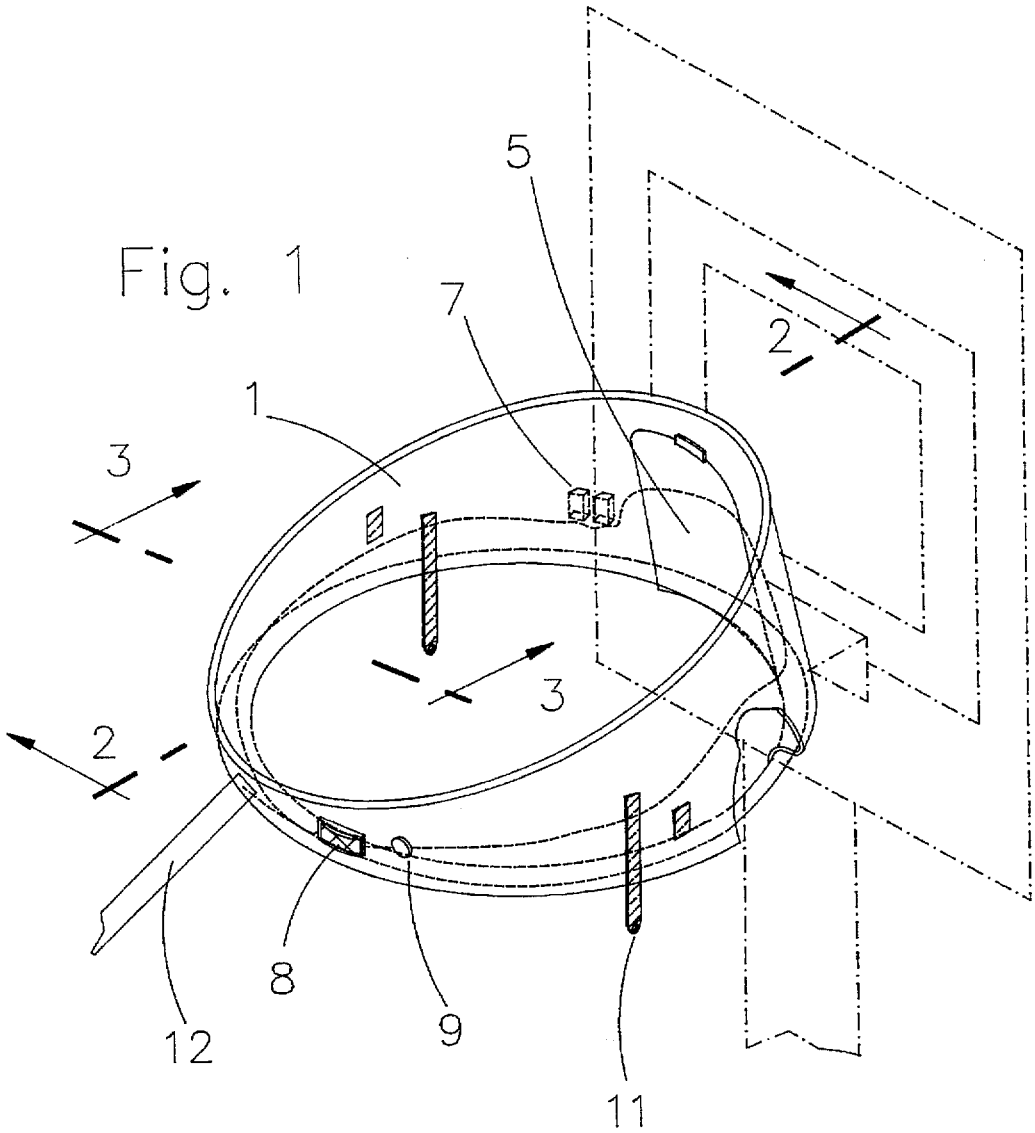
FIG. 1 is a perspective view of the principal portion of the device of this invention mounted onto a basketball rim.
Figure 2:
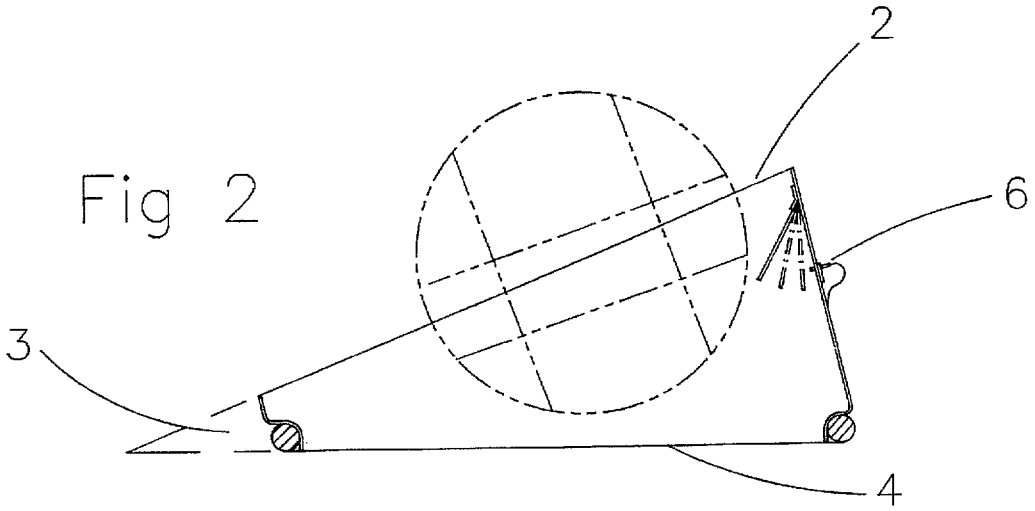
FIG. 2 is a side view of the device. This figure illustrates the ball striking flap portion of the preferred embodiment of the device.
Figure 3:
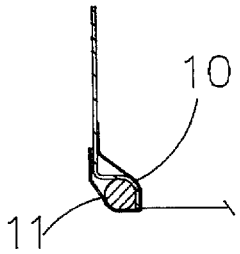
FIG. 3 is a sectional view revealing the rim mounting trench of the bottom annular surface and securing straps of the preferred embodiment of the invention.
Figure 4:
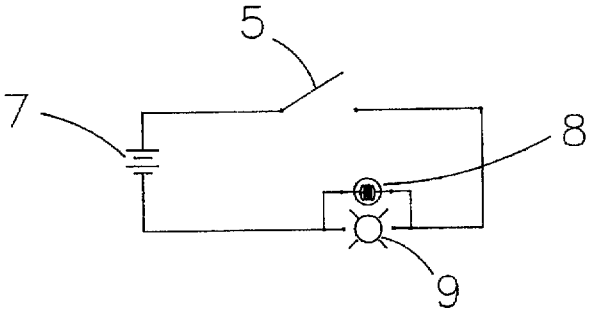
FIG. 4 represents a schematic of the electrical components of one embodiment of the invention.
Figure 5:
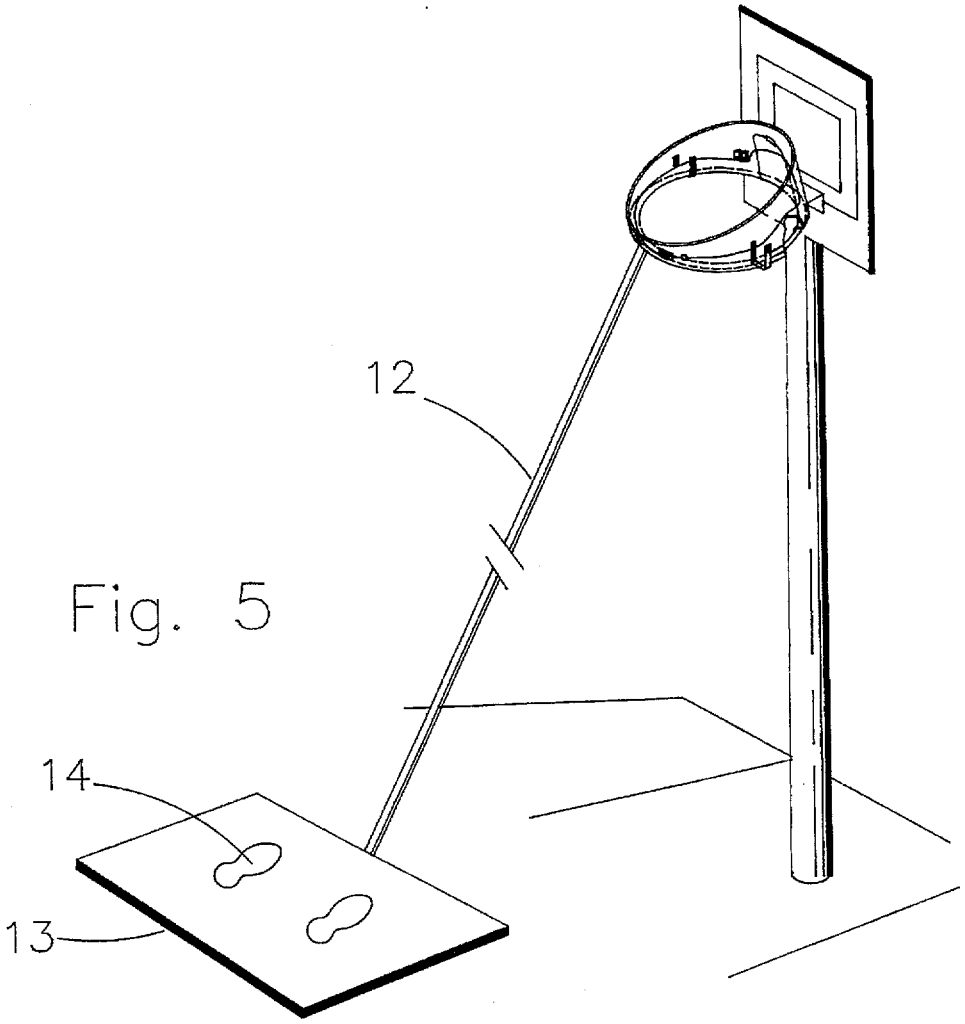
FIG. 5 is a perspective view of one embodiment of the invention.

Although the device in its simplest form is quite useful for improving a basketball player's aim, the preferred embodiment incorporates all of the features set forth in the dependent claims. This embodiment includes a principal annular member 1. The top annular surface 2 is disposed at an angle 3 between 20 and 30 degrees with respect to the bottom annular surface 4, the bottom annular surface lying in the plane of the rim of the goal. With this resulting alteration of the target, the target is more visible and only a ball shot with an ideal trajectory will pass through the goal. A further embodiment comprises a ball striking flap 5 disposed within the principal annular member, an indicator switch 6, a power source 7, in communication with the ball striking flap and with one or more indicators 8 and 9, all housed within the principal annular member. A further embodiment comprises a rim mounting trench 10 formed by the bottom annular surface and securing means 11 for further securing the principal member to the rim. Still a further embodiment comprises a user guideline 12 and foot placement pad 13 with a plurality of foot prints 14 to provide a visual guide for improved shooting accuracy and proper shooting stance. The proper foot prints for a particular player depend upon the height of the player. In its best mode, the user guideline is formed from a nylon strap with a metal loop on one end. The opposite end is threaded through the loop around the rim and pulled tight. The end opposite that, fastened to the goal, should be removably or retractably connected to the foot placement pad.

In the preferred embodiment, the device comprises the rim mounting trench and securing straps. The device can be easily mounted and removed from a standard goal. Many goals are mounted on retractable bases. If not, however, the device can be easily mounted or removed with the aid of a ladder or retractable pole with a hook.

Preferred materials include plastic and fiberglass. The device is best made from clear injection-molded plastic.

With the embodiment comprising indicators, the power source can be batteries or a solar panel.

What is claimed is:

1. A basketball training device for use with a standard basketball goal, the standard basketball goal having a standard rim and backboard, said device comprising a principal annular member, said principal member comprising:

top and bottom annular surfaces, the bottom annular surface lying substantially in the same plane as the rim of the goal, the top annular surface tangential to the bottom annular surface;

an angle between 20 and 30 degrees between the annular surfaces at the point of tangency and defining the relative positions of the annular surfaces and consequently the desirable trajectory of an ideally shot ball;

a means for securing the principle annular member to the standard rim;

a ball striking flap disposed within the principle annular member at a location where it will be struck only by a ball with a undesirable trajectory;

an indicator switch in communication with the ball striking flap such that the indicator switch is activated upon contact by the ball striking flap when the ball striking flap is hit by a ball thrown by the user;

a power source in electrical communication with the indicator switch; and one or more electronic indicators in electrical communication with the power source and indicator switch, such that the indicator is in turn activated by the indicator switch when the ball striking flap is struck by a ball.

2. A device as set forth in claim 1 above where one or more of the indicators is a sound producing device.

3. A device as set forth in claims 1 or 2 above, wherein one or more of the indicators is a light producing device.

4. A device as set forth in claim 1 above whereby said means for securing the device to the rim comprises a securing strap comprising a middle portion, a first end and a second end, whereby the first end is fixably mounted to the interior surface, the second end is removably attached to the exterior surface, whereby the securing device can further secure the device to the rim.

* * * * *